US010499716B2

(12) United States Patent
Lan

(10) Patent No.: US 10,499,716 B2
(45) Date of Patent: Dec. 10, 2019

(54) FOLDING MECHANISM

(71) Applicants: ASO ENTERPRISE CO. LTD., Taipei (TW); Brilliant Travel-Tech Corp., Taipei (TW); DONGGUAN BRILLIANT e-LUGGAGE CORPORATION, Dongguan (CN)

(72) Inventor: Ching-Chung Lan, Taipei (TW)

(73) Assignees: ASO ENTERPRISE CO. LTD., Taipei (TW); BRILLIANT TRAVEL-TECH CORP., Taipei (TW); DONGGUAN BRILLIANT E-LUGGAGE CORPORATION, Dongguan (CN)

( * ) Notice: Subject to any disclaimer, the term of this patent is extended or adjusted under 35 U.S.C. 154(b) by 410 days.

(21) Appl. No.: 15/587,608

(22) Filed: May 5, 2017

(65) Prior Publication Data

US 2018/0320733 A1 Nov. 8, 2018

(51) Int. Cl.

*E05D 3/06* (2006.01)
*E05D 3/14* (2006.01)
*A45C 7/00* (2006.01)

(52) U.S. Cl.

CPC ..... *A45C 7/0022* (2013.01); *E05D 3/06* (2013.01); *E05D 3/14* (2013.01); *Y10T 16/547* (2015.01); *Y10T 16/5475* (2015.01); *Y10T 16/5476* (2015.01)

(58) Field of Classification Search

CPC .... E05D 3/06; E05D 3/12; E05D 3/14; E05D 3/16; E05D 2003/163; E05D 2003/166; Y10T 16/547; Y10T 16/5474; Y10T 16/5475; Y10T 16/5476; A45C 7/0022

USPC ..... 16/366, 368, 369, 370

See application file for complete search history.

(56) References Cited

U.S. PATENT DOCUMENTS 2,200,142 A * 5/1940 Witschi ..... E05D 3/16 16/369
3,450,237 A * 6/1969 Dyke ..... A45C 7/0022 190/103
3,523,596 A * 8/1970 Dyke ..... A45C 7/0022 190/103
RE27,486 E * 9/1972 Dyke ..... A45C 7/0022 190/103
4,128,150 A * 12/1978 Popkin ..... A45C 7/0022 190/103
4,366,886 A * 1/1983 Tawil ..... A45C 7/0022 190/103

(Continued)

*Primary Examiner* — Jeffrey O'Brien
(74) *Attorney, Agent, or Firm* — WPAT, PC

(57) ABSTRACT

A folding mechanism includes two retractable folding assemblies. A first retractable folding assembly includes a first base member, two friction members, two first dual-pivotal plate units, two first fixation plate units and a first pulling member. The two friction members are mounted to opposing ends of the first base member. The first dual-pivotal plate unit is symmetrically pivotally connected with opposing sides of the first base member. The first fixation plate unit is individually pivotally connected with the first dual-pivotal plate unit. The first pulling member is mounted at the first base member. A second retractable folding assembly is structurally resembled to the first retractable folding assembly. A movable buckle unit is further included to buckle or release springily two dual-pivotal plate units of the second retractable folding assembly.

10 Claims, 9 Drawing Sheets

(56) References Cited

U.S. PATENT DOCUMENTS 5,080,206 A * 1/1992 Tawil ..... A45C 7/0022 190/103
5,519,920 A * 5/1996 Runge ..... E05D 3/022 16/221
6,299,011 B1 * 10/2001 Rosenfeldt ..... B65D 9/38 16/388
7,021,437 B2 * 4/2006 Ghiassi ..... A45C 7/0022 190/103
7,086,510 B2 * 8/2006 Smith ..... A45C 7/0022 190/103
8,713,759 B2 * 5/2014 Cai ..... G06F 1/1681 16/366
8,720,011 B1 * 5/2014 Hsu ..... E05D 3/122 16/354
9,555,735 B2 * 1/2017 Kerr, III ..... B60P 7/02
10,041,282 B2 * 8/2018 Cheah ..... G06F 1/1681
2005/0034948 A1 * 2/2005 Tiramani ..... A45C 7/0022 190/107
2013/0220755 A1 * 8/2013 Meersschaert ..... A45C 5/02 190/18 A
2015/0021133 A1 * 1/2015 Xu ..... A45C 5/03 190/18 A
2015/0122810 A1 * 5/2015 Yang ..... A45C 3/00 220/9.4
2015/0286286 A1 * 10/2015 Jiang ..... G06F 3/0221 16/320
2015/0327639 A1 * 11/2015 Antonelli ..... A45C 7/0022 190/18 A
2016/0147267 A1 * 5/2016 Campbell ..... G06F 1/1681 361/679.27
2016/0202736 A1 * 7/2016 Huang ..... G06F 1/1681 16/369
2016/0262515 A1 * 9/2016 Kung ..... A45C 13/1092
2016/0374441 A1 * 12/2016 Atlas ..... A45C 5/14 190/18 A
2017/0020252 A1 * 1/2017 Chin ..... A45C 13/1069
2018/0128029 A1 * 5/2018 Mak ..... F16C 11/04

* cited by examiner

FOLDING MECHANISM

BACKGROUND OF INVENTION

1. Field of the Invention

The invention relates to a folding mechanism, and more particularly to the folding mechanism that can adjust the volume of the carrier object.

2. Description of the Prior Art

An object with fixed structures can't change its volume. Hence, portability and storage become problems.

In the art, some objects claimed to be foldable or retractable are mostly made up of flexible materials, so that the volumes of these objects can be changeable.

In addition, still some other objects claimed to be foldable are usually made up of disassemble-able structures. However, these disassemble-able objects are usually complicated in structuring, and thus featured in uneasy applications and heavy weights.

Hence, it is an urgent need to develop a folding mechanism with an adjustable volume, so that the aforesaid shortcomings can be resolved and the demands in portability and minimal storage size can be substantially satisfied.

SUMMARY OF THE INVENTION

In one embodiment of the present invention, the folding mechanism includes:

at least one first retractable folding assembly, including:

a first base member, having a first end and an opposing second end in a longitudinal direction thereof, further defining a first lateral side and an opposing second lateral side to opposing sides thereof in the longitudinal direction;

two friction members, mounted respectively to the first end and the second end;

two first dual-pivotal plate units, symmetrically pivotally connected with the first base member by closing to the first end and the second end, respectively;

two first fixation plate units, pivotally connected individually with the corresponding first dual-pivotal plate units; and a first pulling member, mounted at the first base member to pull the first pulling member so as further to pull the first base member; and at least one second retractable folding assembly, including:

a second base member, having a third end and an opposing fourth end in a longitudinal direction thereof, further defining a third lateral side and an opposing fourth lateral side to opposing sides thereof in the longitudinal direction;

two second dual-pivotal plate units, symmetrically pivotally connected with the second base member by closing to the third end and the fourth end, respectively;

two second fixation plate units, pivotally connected individually with the corresponding second dual-pivotal plate units; and a movable buckle unit for buckling or releasing springily the two second dual-pivotal plate units.

All these objects are achieved by the folding mechanism described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a folding mechanism. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
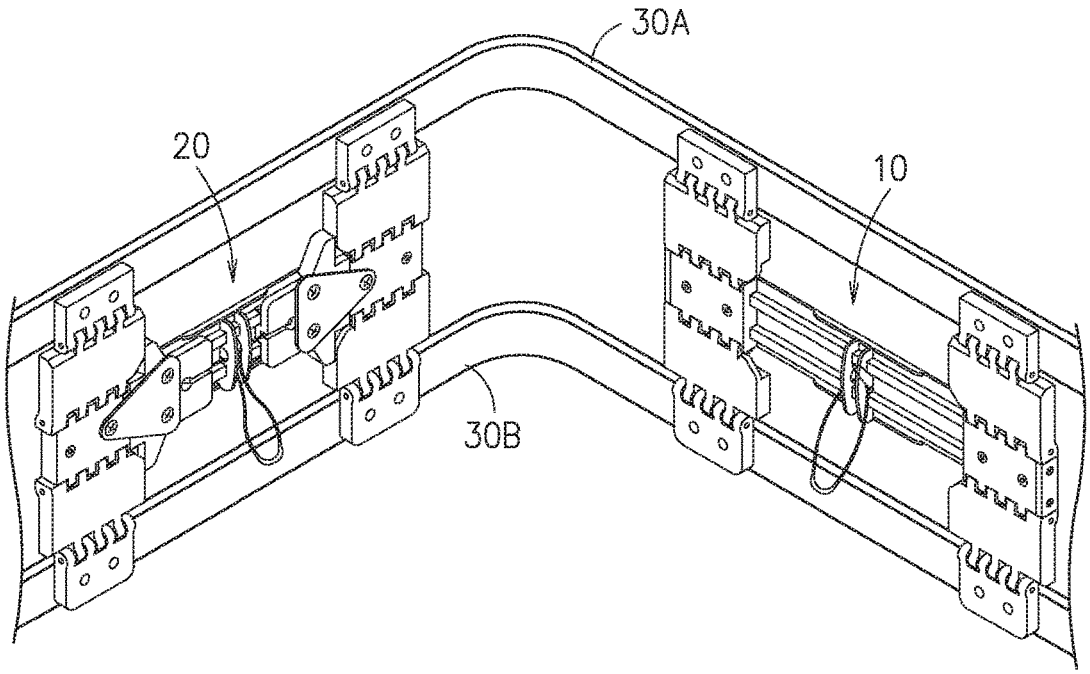
FIG. 1 is a schematic perspective view of an embodiment of the folding mechanism in accordance with the present invention.

Referring now to FIG. 1, the folding mechanism as shown includes a first retractable folding assembly 10 and a second retractable folding assembly 20. The first retractable folding assembly 10 and the second retractable folding assembly 20 are mounted (screwed tightly for example) on a first frame 30A and a second frame 30B inside a first-generation case with five pieces. In FIG. 1, only a single first retractable folding assembly 10 and a single second retractable folding assembly 20 are shown. However, if the object to be folded/unfolded is a rectangular box, then two first retractable folding assemblies 10 can be mounted to two opposing interior surfaces of the box, while two second retractable folding assemblies 20 can be mounted to the other opposing interior surfaces of the box. By having a travel case for example (but not limited to), the two first retractable folding assemblies 10 can be mounted to two vertical sides of the case, and the two second retractable folding assemblies 20 can be mounted to two horizontal sides of the case.

Figure 2:
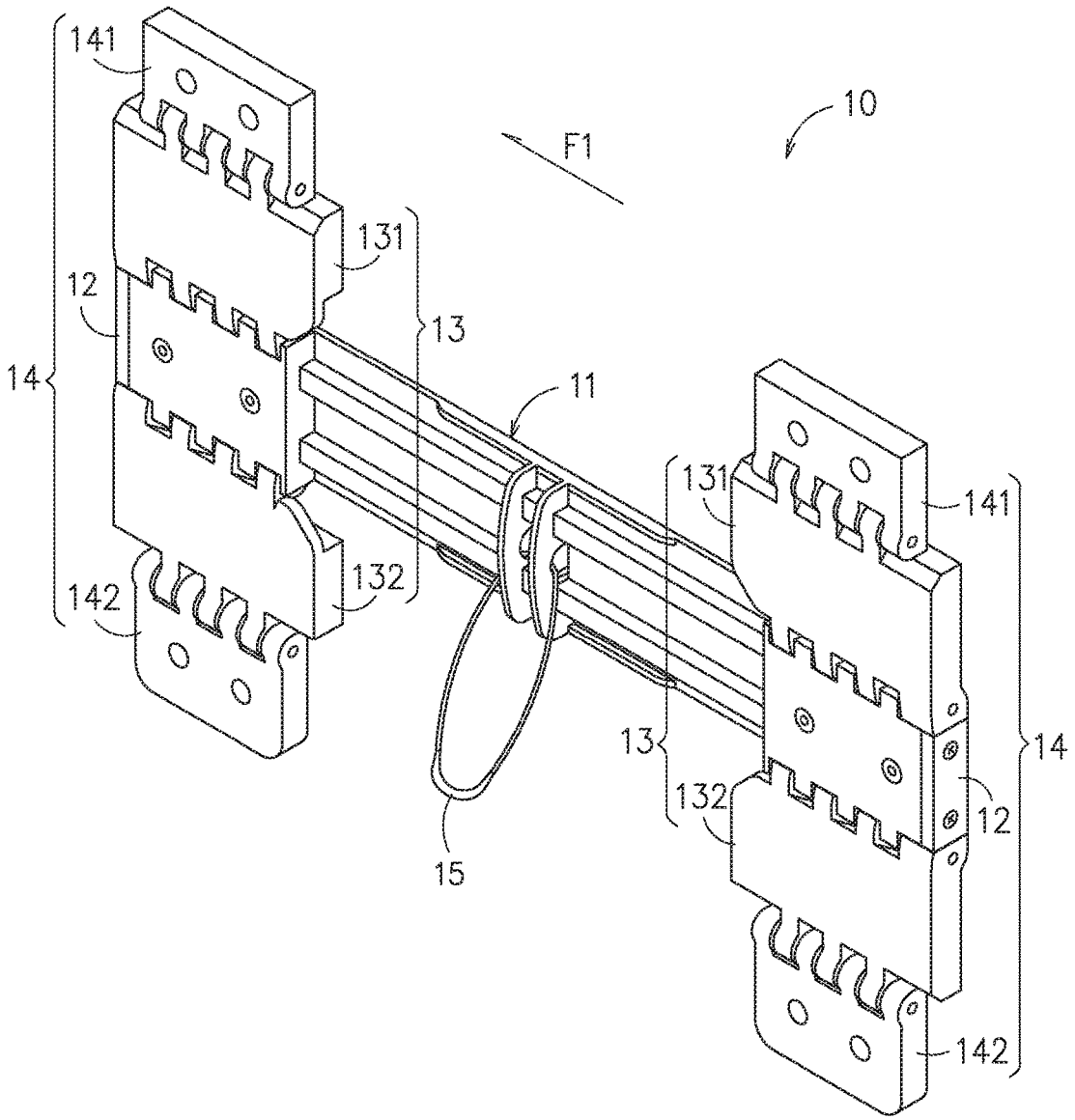
FIG. 2 is a schematic perspective view of the first retractable folding assembly of FIG. 1.
Figure 3:
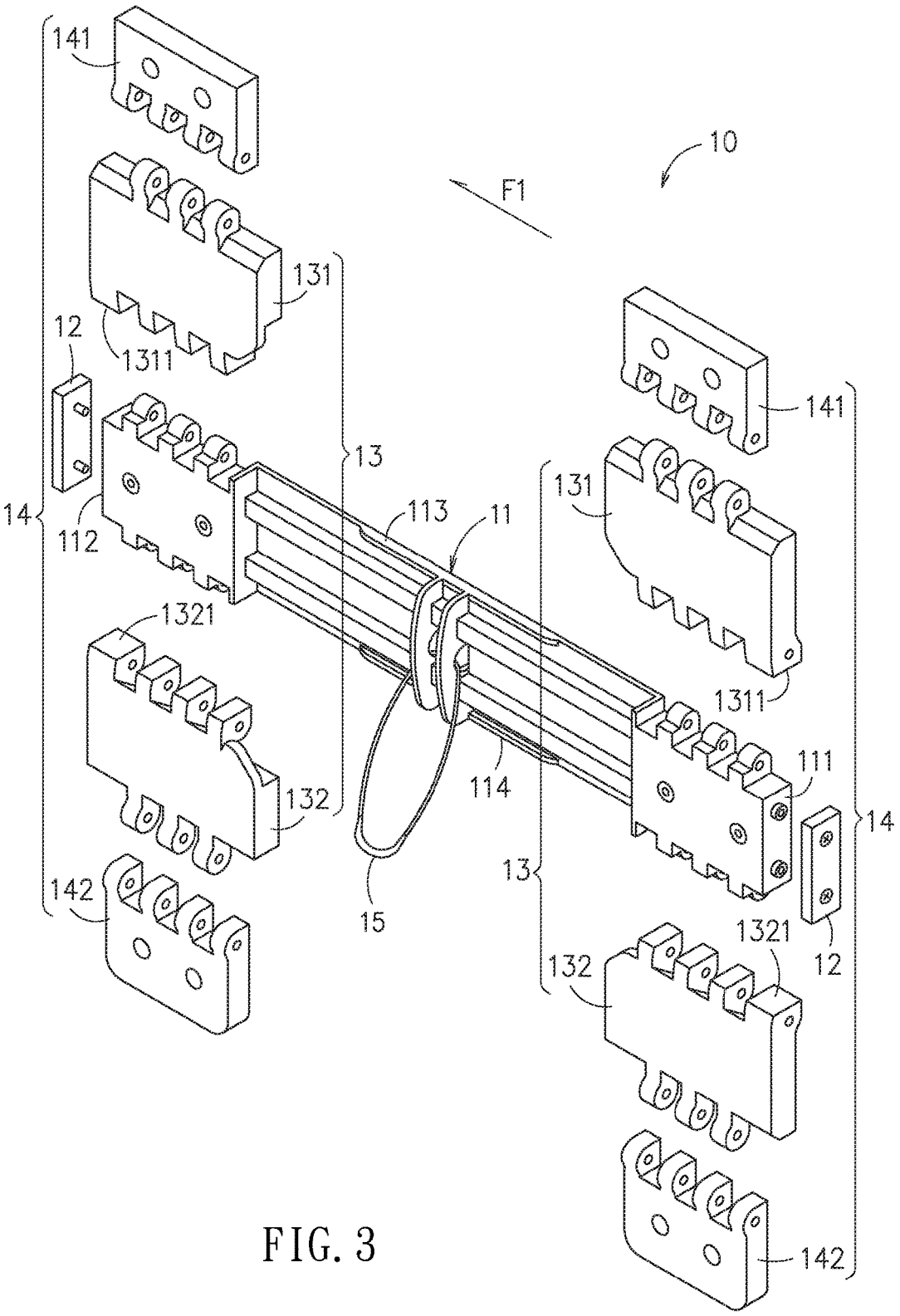
FIG. 3 is a schematic exploded view of FIG. 2.

Referring to FIG. 1 to FIG. 3, the first retractable folding assembly 10 includes a first base member 11, two friction members 12, two first dual-pivotal plate unit 13, two first fixation plate units 14 and a first pulling member 15.

The first base member 11 extended in the longitudinal direction F1 has a first end 111 and a second end 112 opposing to the first end 111. Two opposing sides of the first base member 11 that also extend in the longitudinal direction F1 are defined as a first lateral side 113 and a second lateral side 114.

The two friction members 12 are mounted to the first end 111 and the second end 112, respectively. The friction member 12 is made of a rubber.

The two first dual-pivotal plate units 13 are symmetrically pivotally engaged with the respective ends of the first base member 11 by closing to the first end 111 and the second end 112, respectively. The first dual-pivotal plate unit 13 includes a first dual-pivotal plate 131 and a second dual-pivotal plate 132, located to opposing sides of the corresponding end of the first base member 11. The first dual-pivotal plate 131 and the second dual-pivotal plate 132 are symmetrically pivotally connected with the corresponding ends of the first base member 11 from the first lateral side 113 and the second lateral side 114. Further, the first dual-pivotal plate 131 and the second dual-pivotal plate 132 have individually friction surfaces 1311, 1321 at places corresponding to the friction members 12.

The two first fixation plate units 14 are individually pivotally connected with the corresponding first dual-pivotal plate units 13. Each of the first fixation plate units 14 includes a first fixation plate 141 and a second fixation plate 142. The first fixation plate 141 is pivotally connect with the first dual-pivotal plate 131 at one side of the first base member 11, while the second fixation plate 142 is pivotally connected with the second dual-pivotal plate 132 at another side of the first base member 11. In addition, the first fixation plate 141 and the second fixation plate 142 are fixedly mounted at the first frame 30A and the second frame 30B, respectively.

The first pulling member 15 is connected roughly to a central part of the first base member 11.

Figure 4:
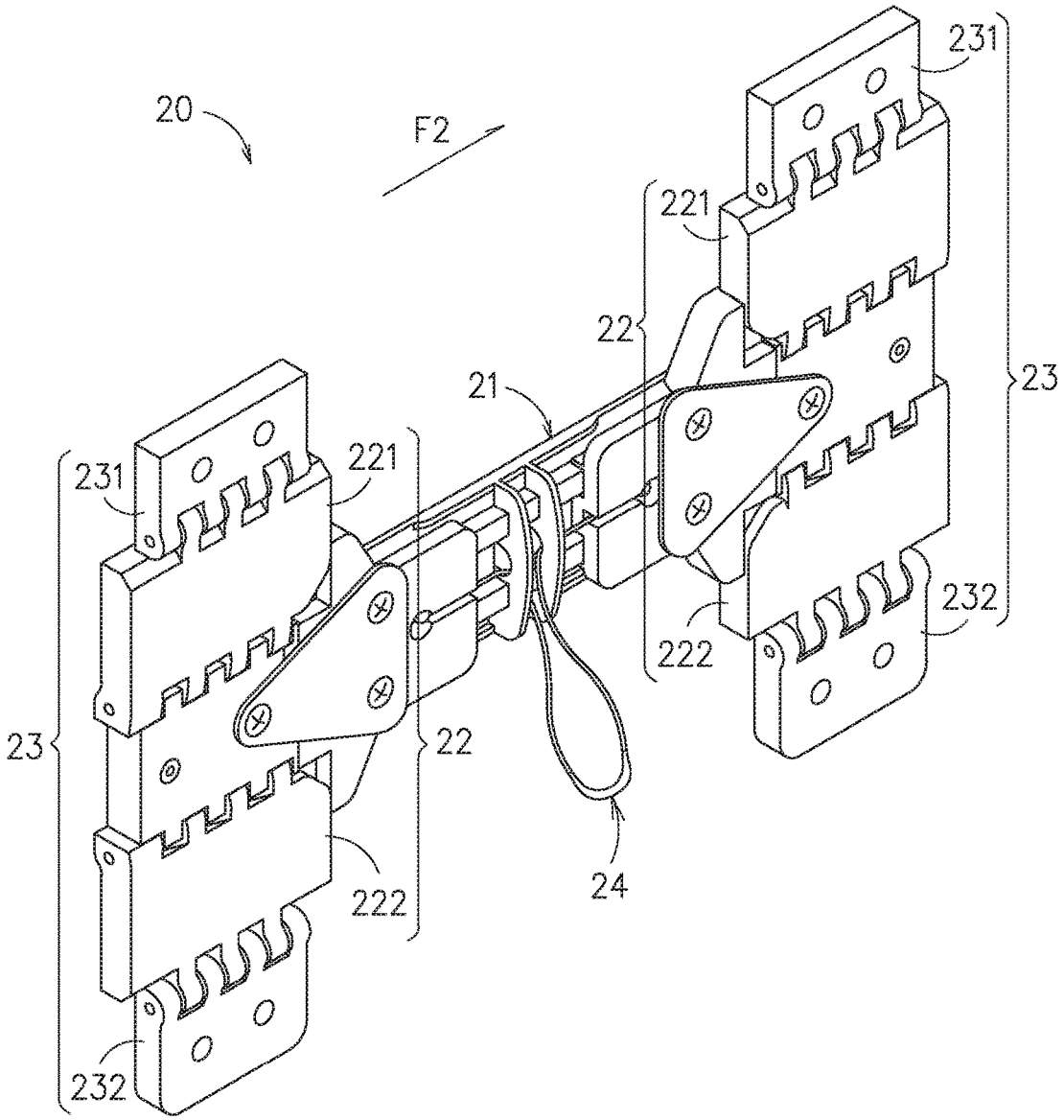
FIG. 4 is a schematic perspective view of the second retractable folding assembly of FIG. 1.
Figure 5:
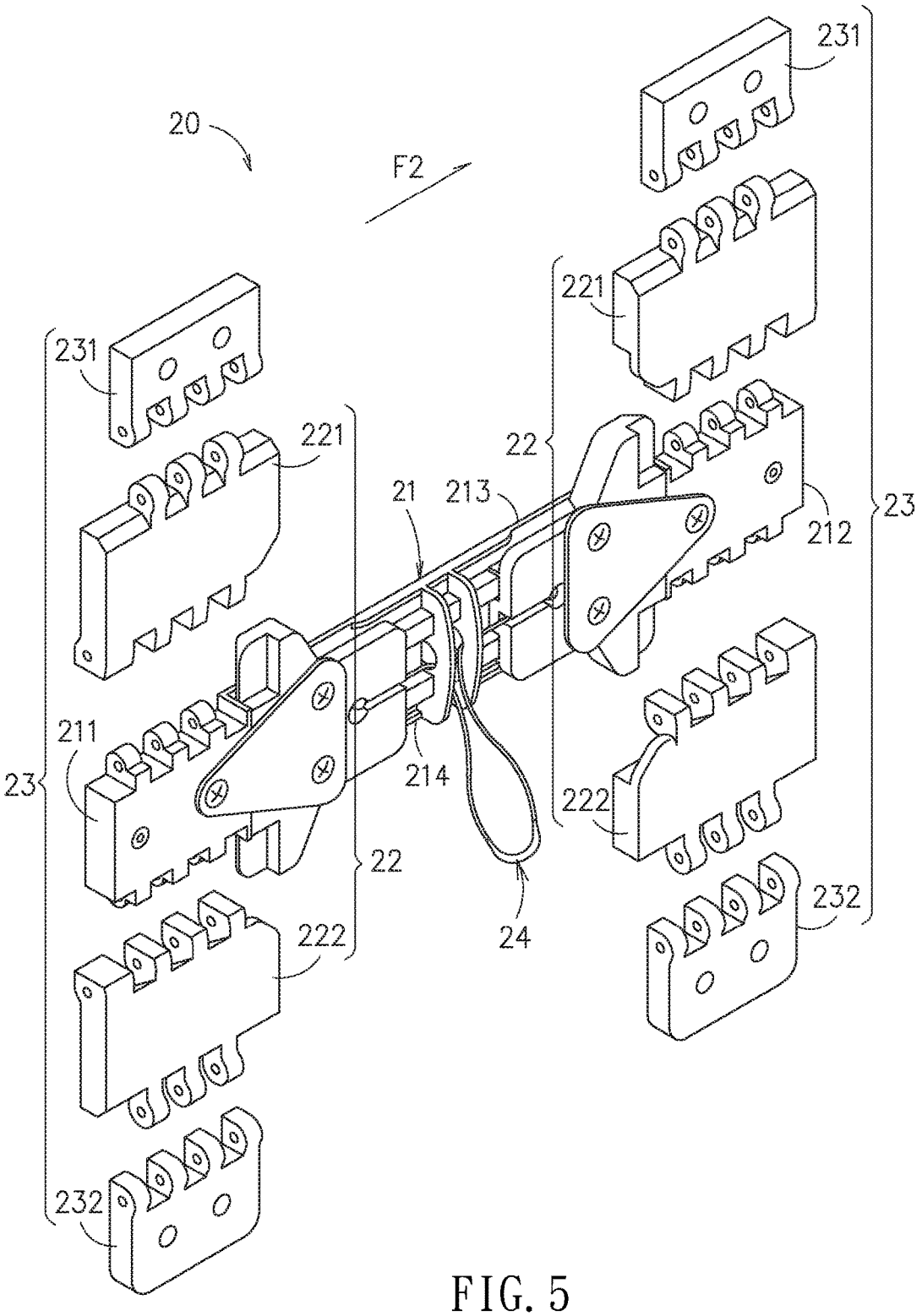
FIG. 5 is a schematic exploded view of FIG. 4.

Referring to FIG. 1, FIG. 4 and FIG. 5, the second retractable folding assembly 20 includes a second base member 21, two second dual-pivotal plate units 22, two second fixation plate units 23 and a movable buckle unit 24.

The second base member 21 extended in the longitudinal direction F2 has a third end 211 and a fourth end 212 opposing to the third end 211. Two opposing sides of the second base member 21 that also extend in the longitudinal direction F2 are defined as a third lateral side 213 and a fourth lateral side 214.

The two second dual-pivotal plate units 22 are symmetrically pivotally engaged with the respective ends of the second base member 21 by closing to the third end 211 and the fourth end 212, respectively. The second dual-pivotal plate unit 22 includes a third dual-pivotal plate 221 and a fourth dual-pivotal plate 222, located to opposing sides of the corresponding end of the second base member 21. The third dual-pivotal plate 221 and the fourth dual-pivotal plate 222 are symmetrically pivotally connected with the corresponding ends of the second base member 21 from the third lateral side 213 and the fourth lateral side 214.

The two second fixation plate units 23 are individually pivotally connected with the corresponding second dual-pivotal plate units 22. Each of the second fixation plate units 23 includes a third fixation plate 231 and a fourth fixation plate 232. The third fixation plate 231 is pivotally connect with the third dual-pivotal plate 221 at one side of the second base member 21, while the fourth fixation plate 222 is pivotally connected with the fourth dual-pivotal plate 222 at another side of the second base member 21. In addition, the third fixation plate 231 and the fourth fixation plate 232 are fixedly mounted at the first frame 30A and the second frame 30B, respectively.

Figure 6:
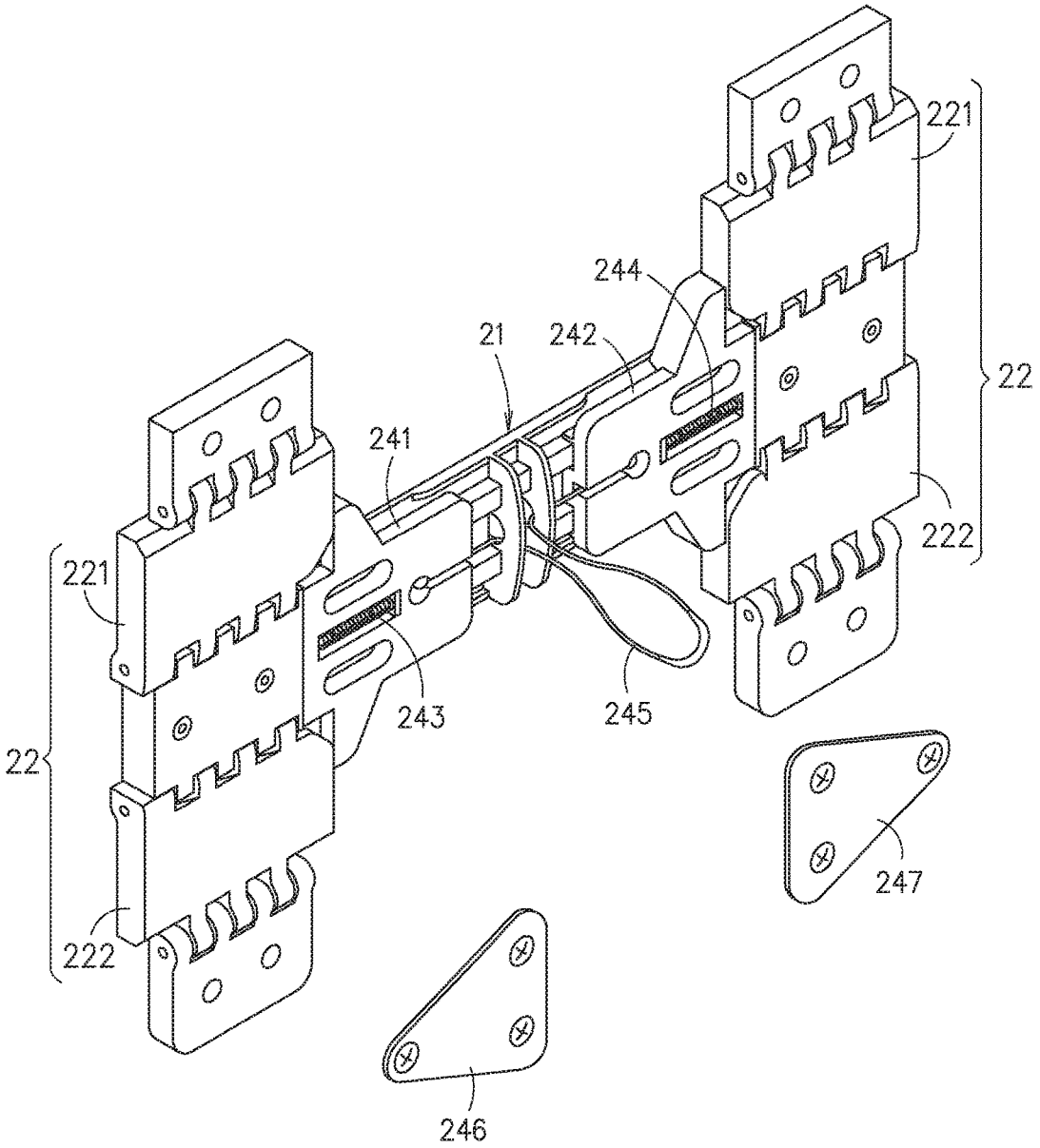
FIG. 6 is another view of FIG. 4 by separating the two cover plates.
Figure 7:
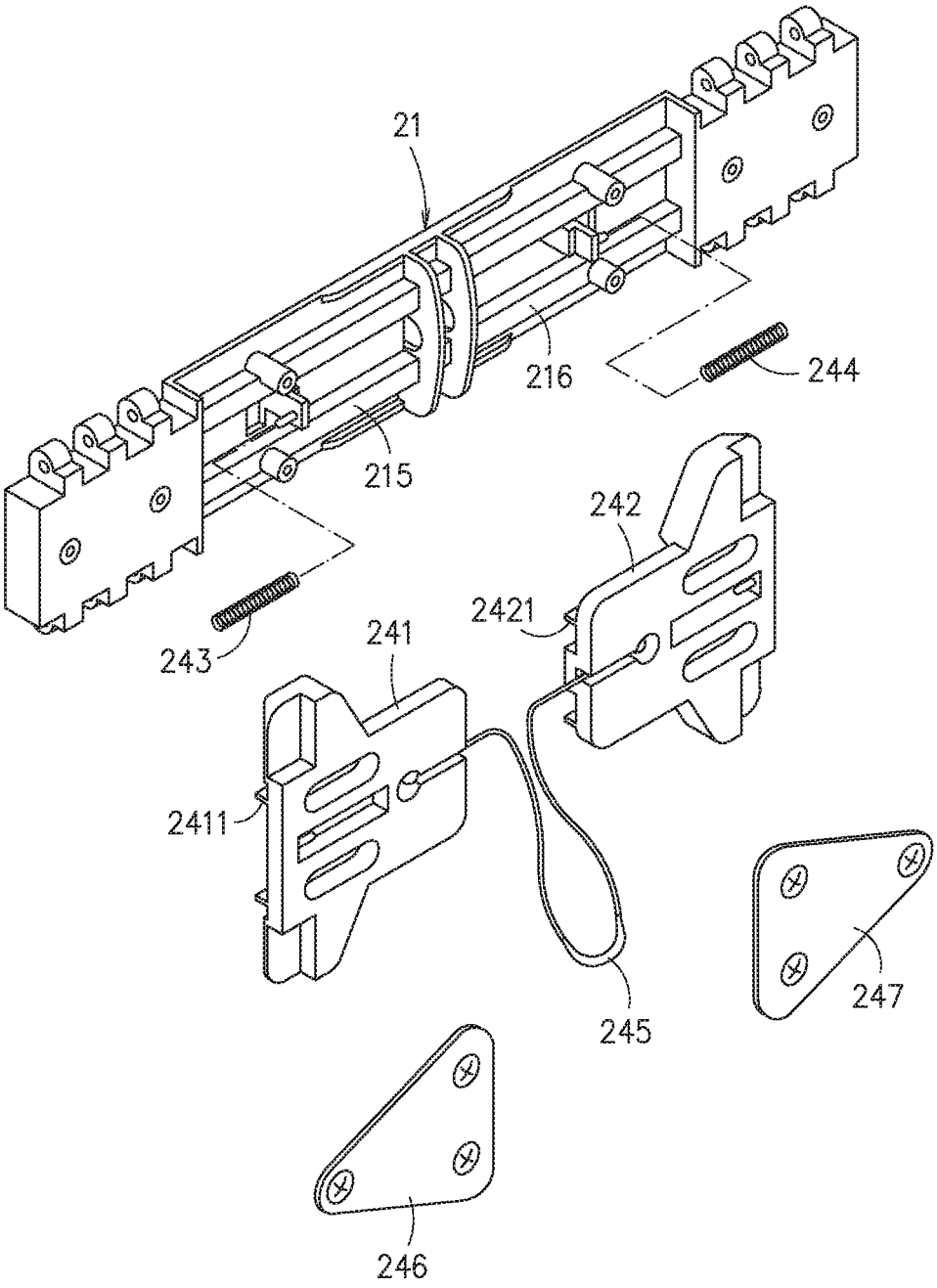
FIG. 7 is an exploded view of the second base member and the movable buckle unit of FIG. 4.

Referring to FIG. 5 to FIG. 7, the movable buckle unit 24 is to buckle or release springily two second dual-pivotal plate units 22. The movable buckle unit 24 includes a first buckle member 241, a second buckle member 242, a first spring member 243, a second spring member 244 and a second pulling member 245. The first buckle member 241 is to buckle or release the third dual-pivotal plate 221 and the fourth dual-pivotal plate 222 of one of the second dual-pivotal plate units 22 (for example, the left-hand-side second dual-pivotal plate unit 22 in the figure), while the second buckle member 242 is to buckle or release the third dual-pivotal plate 221 and the fourth dual-pivotal plate 222 of another second dual-pivotal plate unit 22 (the right-hand-side second dual-pivotal plate unit 22 in the figure). On a surface of the second base member 21, a surface of the first buckle member 241 facing the surface of the second base member 21, and a surface of the second buckle member 241 facing the surface of the second base member 21, meshed slippery racks 215, 216, 2411, 2421 are located for allowing linear sliding movements of the first and second buckle members 241, 242 longitudinally along the second base member 21. Over the second base member 21, a first cover plate 246 and a second cover plate 247 are fixed located (for example, by screw fastening as shown). The first buckle member 241 is located between the first cover plate 246 and the second base member 21, while the second buckle member 242 is located between the second cover plate 247 and the second base member 21. The first spring member 243 is mounted between the second base member 21 and the first buckle member 241, while the second spring member 244 is mounted between the second base member 21 and the second buckle member 242. The second pulling member 245 is located to connect the first buckle member 241 and the second buckle member 242.

Figure 8:
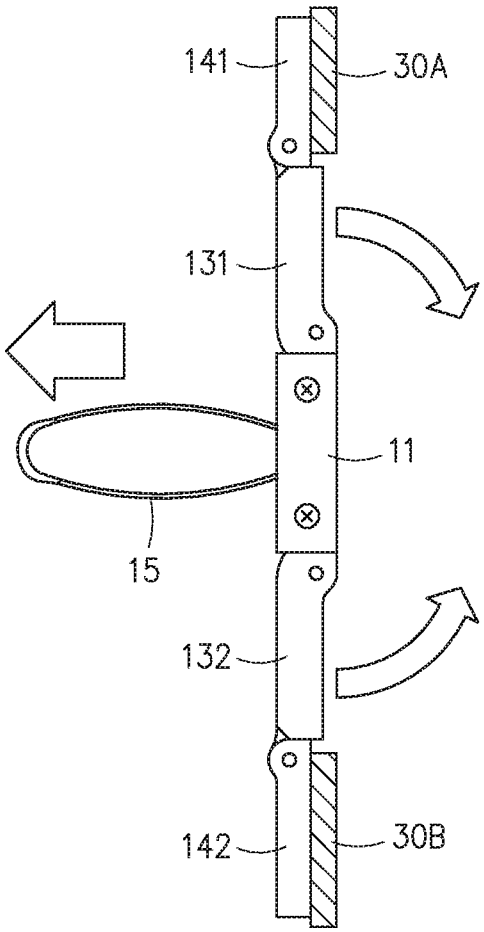
FIG. 8 is a lateral side view of the first retractable folding assembly of FIG. 1, in an unfolded state.
Figure 9:
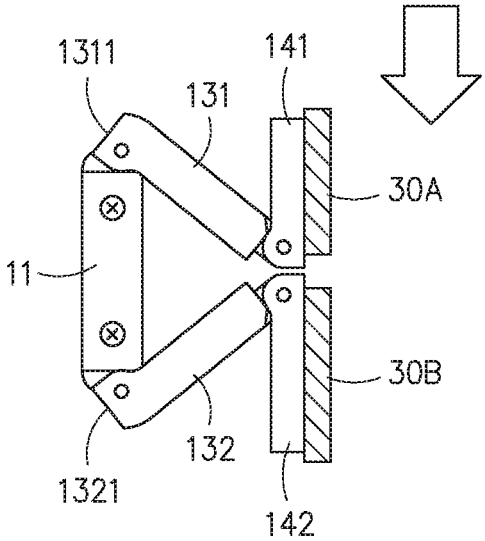
FIG. 9 is another lateral side view of the first retractable folding assembly of FIG. 1, in a folded state.

Referring to FIG. 8 and FIG. 9, by pulling the first pulling member 15, the first base member 11 can be pulled out so as to pivot the first dual-pivotal plate 131 and the second dual-pivotal plate 132 about the first base member 11. At the same time, frictions between the friction surfaces 1311, 1321 and the friction member 12 would act as the resistance to avoid arbitrary rotations of the first dual-pivotal plate 131 and the second dual-pivotal plate 132. Then, if no other forcing is involved, the first frame 30A associated with the first dual-pivotal plate 131 and the first fixation plate 141 would be pulled to move toward the second frame 30B associated with the second dual-pivotal plate 132 and the second fixation plate 142, as shown in FIG. 9.

Figure 10:
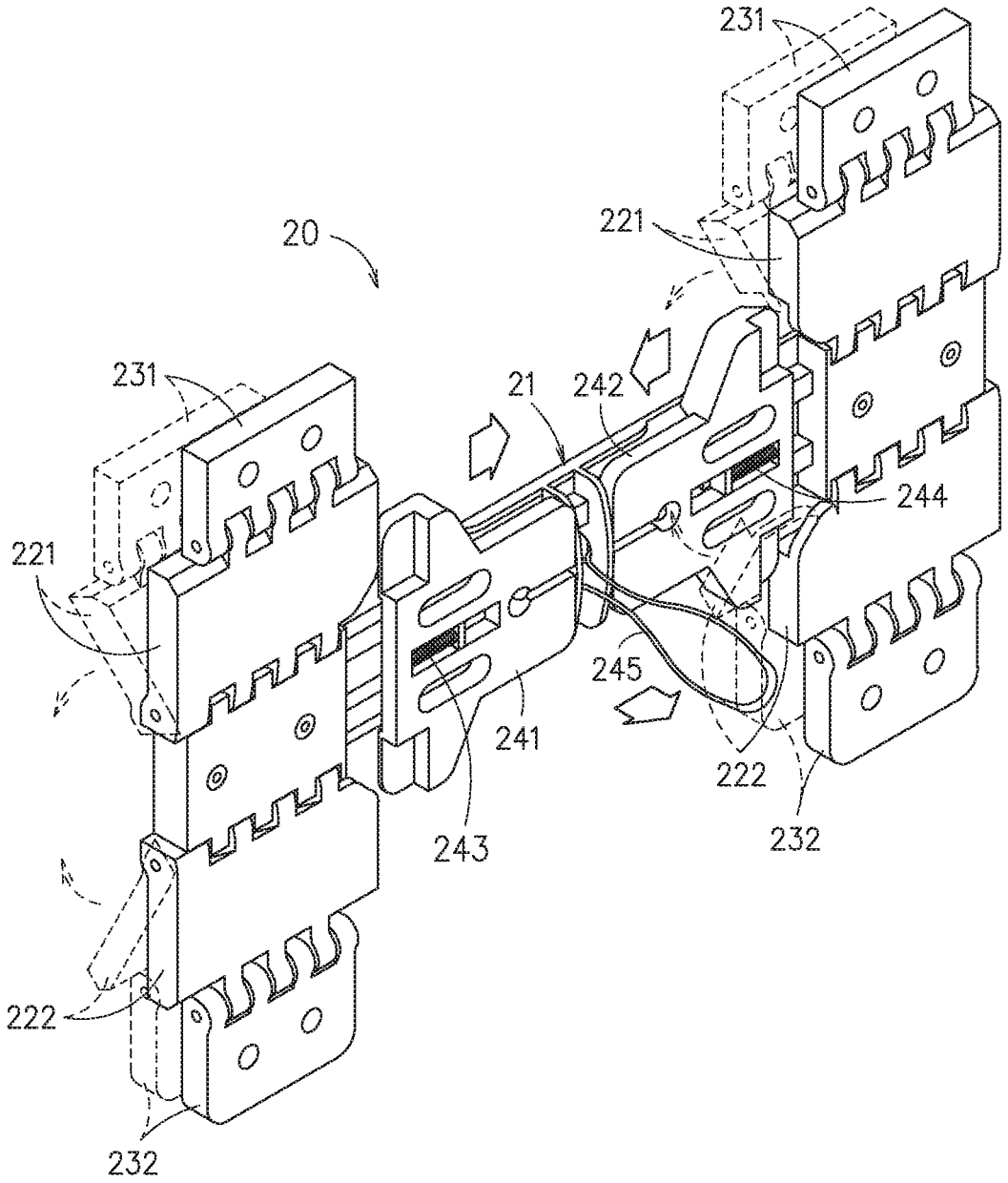
FIG. 10 is another view of FIG. 4, with the two cover plates removed and in a retracted state of the second retractable folding assembly.

Referring to FIG. 1 and FIG. 10, by pulling the second pulling member 245 so as to drive the first buckle member 241 to approach the second buckle member 242, such that the third dual-pivotal plate 221 and the fourth dual-pivotal plate 222 can then present to be rotatable. Thus, the first spring member 243 and the second spring member 244 would be compressed, the second base member 21 would be pulled away of the frames 30A, 30B, and the third dual-pivotal plate 221 and the fourth dual-pivotal plate 222 would be simultaneously turned. Since the second retractable folding assembly 20 does not include the friction member 12 like that in the first retractable folding assembly 10 as shown in FIG. 2 or 3, thus the first frame 30A, the third dual-pivotal plate 221 and the third fixation plate 231 would approach the second frame 30B, the fourth dual-pivotal plate 222 and fourth fixation plate 232 respectively, by themselves due to the gravity while the second base member 21 is pulled out, similar to the state shown in FIG. 9. when the second pulling member 245 is released, the first buckle member 241 and the second buckle member 242 would be separated springily by the first spring member 243 and the second spring member 244.

By applying the operations shown in FIG. 8 to FIG. 10, the height and volume of the object to be unfolded can be adjusted. Similarly, by applying reverse operations, the unfolded object can be folded to resume the original height and volume.

In summary, by providing the folding mechanism in accordance with the present invention, the object's volume can be more controllable, the folding/unfolding operations can be easier, and thus the portability and the storage convenience can be substantially enhanced.

While the present invention has been particularly shown and described with reference to a preferred embodiment, it will be understood by those skilled in the art that various changes in form and detail may be without departing from the spirit and scope of the present invention.

What is claimed is:

1. A folding mechanism, comprising:

at least one first retractable folding assembly, including:

a first base member, having a first end and an opposing second end in a longitudinal direction thereof, further defining a first lateral side and an opposing second lateral side to opposing sides thereof in the longitudinal direction;

two friction members, mounted respectively to the first end and the second end;

two first dual-pivotal plate units, symmetrically pivotally connected with the first base member at the first end and the second end, respectively;

two first fixation plate units, pivotally connected individually with the corresponding first dual-pivotal plate units; and a first pulling member, mounted at the first base member, wherein pulling the first pulling member causes the at least one first retractable folding assembly to collapse from a first position in which the first base member is substantially coplanar with the two first fixation plate units to a second position in which the first base member is substantially parallel to the two first fixation plate units; and at least one second retractable folding assembly, including:

a second base member, having a third end and an opposing fourth end in a longitudinal direction thereof, further defining a third lateral side and an opposing fourth lateral side to opposing sides thereof in the longitudinal direction;

two second dual-pivotal plate units, symmetrically pivotally connected with the second base member at the third end and the fourth end, respectively;

two second fixation plate units, pivotally connected individually with the corresponding second dual-pivotal plate units; and a movable buckle unit for buckling or releasing springily the two second dual-pivotal plate units.

2. The folding mechanism of claim 1, wherein each first dual-pivotal plate unit further includes a first dual-pivotal plate and a second dual-pivotal plate; wherein the first dual-pivotal plate and the second dual-pivotal plate are symmetrically located at the first lateral side and the second lateral side, each of the first dual-pivotal plate and the second dual-pivotal plate has a friction surface to contact with the corresponding friction member, and friction resistance between the friction surface and the friction member is generated when the first dual-pivotal plate moves relatively to the corresponding second dual-pivotal plate.

3. The folding mechanism of claim 2, wherein each of the first fixation plate units further includes a first fixation plate and a second fixation plate; wherein the first fixation plate is pivotally connected with the corresponding first dual-pivotal plate at one side of the first base member, the second fixation plate is pivotally connected with the corresponding second dual-pivotal plate at another side of the first base member, and the first fixation plate and the second fixation plate are individually fixedly mounted at a first frame and a second frame of a storage box, respectively.

4. The folding mechanism of claim 3, wherein each of the second dual-pivotal plate units includes a third dual-pivotal plate and a fourth dual-pivotal plate; wherein the third dual-pivotal plate and the fourth dual-pivotal plate are symmetrically pivotally connected with the second base member at the third lateral side and the fourth lateral side, respectively.

5. The folding mechanism of claim 4, wherein each of the second fixation plate units includes a third fixation plate and a fourth fixation plate; wherein the third fixation plate is pivotally connected with the corresponding third dual-pivotal plate at one side of the second base member, the fourth fixation plate is pivotally connected with the corresponding fourth dual-pivotal plate at another side of the second base member, and the third fixation plate and the fourth fixation plate are individually fixedly mounted at a first frame and a second frame of a storage box, respectively.

6. The folding mechanism of claim 4, wherein the movable buckle unit include:

a first buckle member for buckling or releasing the third dual-pivotal plate and the fourth dual-pivotal plate of one said second dual-pivotal plate unit;

a second buckle member for buckling or releasing another one of the third dual-pivotal plate and the fourth dual-pivotal plate of another said second dual-pivotal plate unit;

a first spring member, mounted between the second base member and the first buckle member;

a second spring member, mounted between the second base member and the second buckle member; and a second pulling member, mounted between the first buckle member and the second buckle member, pulled to drive the first buckle member to approach the second buckle member so as to turn the third dual-pivotal plates and the fourth dual-pivotal plates.

7. The folding mechanism of claim 6, wherein a surface of the second base member, a surface of the first buckle member facing the second base member, and a surface of the second buckle member facing the second base member are constructed with matching slippery racks.

8. The folding mechanism of claim 6, wherein the second base member has a first cover plate and a second cover plate; wherein the first buckle member is mounted between the first cover plate and the second base member, and the second buckle member is mounted between the second cover plate and the second base member.

9. The folding mechanism of claim 1, wherein the first pulling member is roughly mounted at a center of the first base member.

10. The folding mechanism of claim 1, wherein the friction member is made of a rubber.

* * * * *